US009669273B2

(12) United States Patent
Lai

(10) Patent No.: US 9,669,273 B2
(45) Date of Patent: Jun. 6, 2017

(54) GOLF BAG

(71) Applicant: Wei-Hung Lai, Taichung (TW)

(72) Inventor: Wei-Hung Lai, Taichung (TW)

( * ) Notice: Subject to any disclaimer, the term of this patent is extended or adjusted under 35 U.S.C. 154(b) by 161 days.

(21) Appl. No.: 14/816,077

(22) Filed: Aug. 3, 2015

(65) Prior Publication Data

US 2017/0036079 A1 Feb. 9, 2017

(51) Int. Cl.
*A63B 55/00* (2015.01)
*A63B 55/57* (2015.01)
*A63B 55/40* (2015.01)

(52) U.S. Cl.
CPC ..... *A63B 55/57* (2015.10); *A63B 55/40* (2015.10)

(58) Field of Classification Search
CPC ..... A63B 55/57; A63B 55/40
See application file for complete search history.

(56) References Cited

U.S. PATENT DOCUMENTS 6,390,295 B2 * 5/2002 Rhee ..... A63B 55/53 206/315.7
7,500,560 B2 * 3/2009 Fair ..... A63B 55/408 206/315.3
D675,431 S * 2/2013 Tang ..... D3/255
8,365,908 B2 * 2/2013 Shiao ..... A63B 55/53 206/315.7
8,910,785 B2 * 12/2014 Loudenslager ..... A63B 55/045 206/315.7
9,533,204 B2 * 1/2017 McGuire ..... A63B 55/00
2009/0308768 A1 * 12/2009 Quartarone ..... A63B 55/00 206/315.7
2010/0147713 A1 * 6/2010 Huang ..... A63B 55/53 206/315.7
2011/0005949 A1 * 1/2011 Shiao ..... A63B 55/53 206/315.7
2012/0279883 A1 * 11/2012 Lai ..... A63B 55/53 206/315.7

* cited by examiner

*Primary Examiner* — Tri Mai
(74) *Attorney, Agent, or Firm* — Bruce Stone LLP; Joseph Bruce

(57) ABSTRACT

A golf bag is provided with a lower frame, an inner frame, two positioning support members, an upper frame, an outer support member and a cover. The two slots are provided at two opposite sides of the inner frame, the magnetic member is disposed on the inner surface of each of the slots, the first receiving cavities are formed on the lower frame, the magnetic end of the positioning support members are inserted in the slots and attracted by the magnetic members, and another end of the positioning support members are inserted in the first receiving cavities, all these arrangements contribute to strengthening the connection between the inner and lower frames, consequently stabilizing the structure of the golf bag.

5 Claims, 9 Drawing Sheets

GOLF BAG

BACKGROUND OF THE INVENTION

Field of the Invention

The present invention relates to a golf equipment, and more particularly to a golf bag.

Related Prior Art

As shown in FIGS. 1 and 2, a conventional golf bag includes: an upper frame 10, a lower frame 11 and a plurality of inner support rods 12. Each of the inner support rods 12 has two ends connected to the upper and lower frames 10, 11, respectively. A cover 13 covers the upper and lower frames 10, 11 and the inner support rods 12, so as to form a bag 14. The upper frame 10 is further provided with an outer support member 15, and a resilient assistant support rod 16 disposed between the outer support member 15 and the lower frame 11. The bag 14 can be placed in an inclined manner to facilitate taking out the golf ball, with the outer support member 15 supporting the bag 14, and the assistant support rod 16 supporting the outer support member 15.

When the golf bag is placed at an inclined angle θ as shown in FIG. 2, and each of the inner support rods 12 has two ends connected to the upper and lower frames 10, 11, respectively, the lower frame 11 is also inclined at an angle θ and has one side contacting the ground instead of flatly abutting against the ground, so that the golf bag is likely to fall down to the ground.

Referring then to FIGS. 3 and 4, another conventional golf bag includes: an upper frame 20, a lower frame 21 and a plurality of inner support rods 22 between the upper and lower frames 20, 21. Then a cover 23 covers the upper and lower frames 20, 21, and the inner support rods 22 to create a bag 24. The upper frame 20 is provided with an outer support member 25, and a resilient assistant support rod 26 between the outer support member 25 and the lower frame 21. Between the upper and lower frames 20, 21 is further provided an inner frame 27. Each of the inner support rods 22 has two ends connected to the upper and inner frames 20, 27, respectively. The inner and lower frames 27, 21 each have one end pivotally connected to each other by a pivot 28, which allows the inner frame 27 to pivot with respect to the lower frame 21 by rotating around the pivot 28. At another end of the inner and lower frames 27, 21 is defined an inclined space W.

Since the inner and lower frames 27, 21 are pivoted to each other by the pivot 28, and there is an inclined space W between the inner and lower frames 27, 21, when the inner frame 27 is inclined at an angle, the upper and inner frames 20, 21 will also be inclined at the same angle as the inner frame 27, so that the lower frame 21 can keep flatly abutting against the ground.

However, when the golf bag stands in an upright position, the lower and inner frames 21, 27 only has one end pivoted to each other by the pivot 28, the connection between the lower and inner frames 21, 27 is weak and unstable.

The present invention has arisen to mitigate and/or obviate the afore-described disadvantages.

SUMMARY

The present invention is aimed at providing a golf bag, wherein the structure of the golf bag is stabilized.

Therefore, a golf bag in accordance with a preferred embodiment of the present invention is provided with a lower frame, an inner frame, two positioning support members, an upper frame, an outer support member and a cover.

The lower frame is provided with a plurality of first receiving cavities.

The inner frame includes one end pivoted to one end of the lower frame via a pivoting device so as to be able to pivot with respect to the lower frame by pivoting about the pivoting device. An inclined space is formed between the lower and inner frame, two slots are provided at two opposite sides of the inner frame, and on an inner surface of each of the slots is provided at least one magnetic member. Around the peripheral edge of the inner frame is formed a plurality of second receiving cavities.

The two positioning support members each have a magnetic end which is made of magnetically attractive metal inserted in a corresponding one of the slots of the inner frame, wherein the magnetic end is attracted by the magnetic member, and another end of the each of the positioning support members is inserted in a corresponding one of the first receiving cavities of the lower frame.

The upper frame is provided with a plurality of inner support members, each of the inner support members has one end inserted in a corresponding one of the second receiving cavities of the inner frame and another end fixed to the upper frame, and the upper frame is formed with a plurality of apertures.

The outer support member is provided on the upper frame.

The cover covers the upper frame, the lower frame, the inner frame and the inner support members, so as to form a bag.

The two slots are provided at two opposite sides of the inner frame, the magnetic member is disposed on the inner surface of each of the slots, the first receiving cavities are formed on the lower frame, the magnetic end of the positioning support members are inserted in the slots and attracted by the magnetic members, and another end of the positioning support members are inserted in the first receiving cavities, all these arrangements contribute to strengthening the connection between the inner and lower frames, consequently stabilizing the structure of the golf bag.

DETAILED DESCRIPTION

Figure 1:
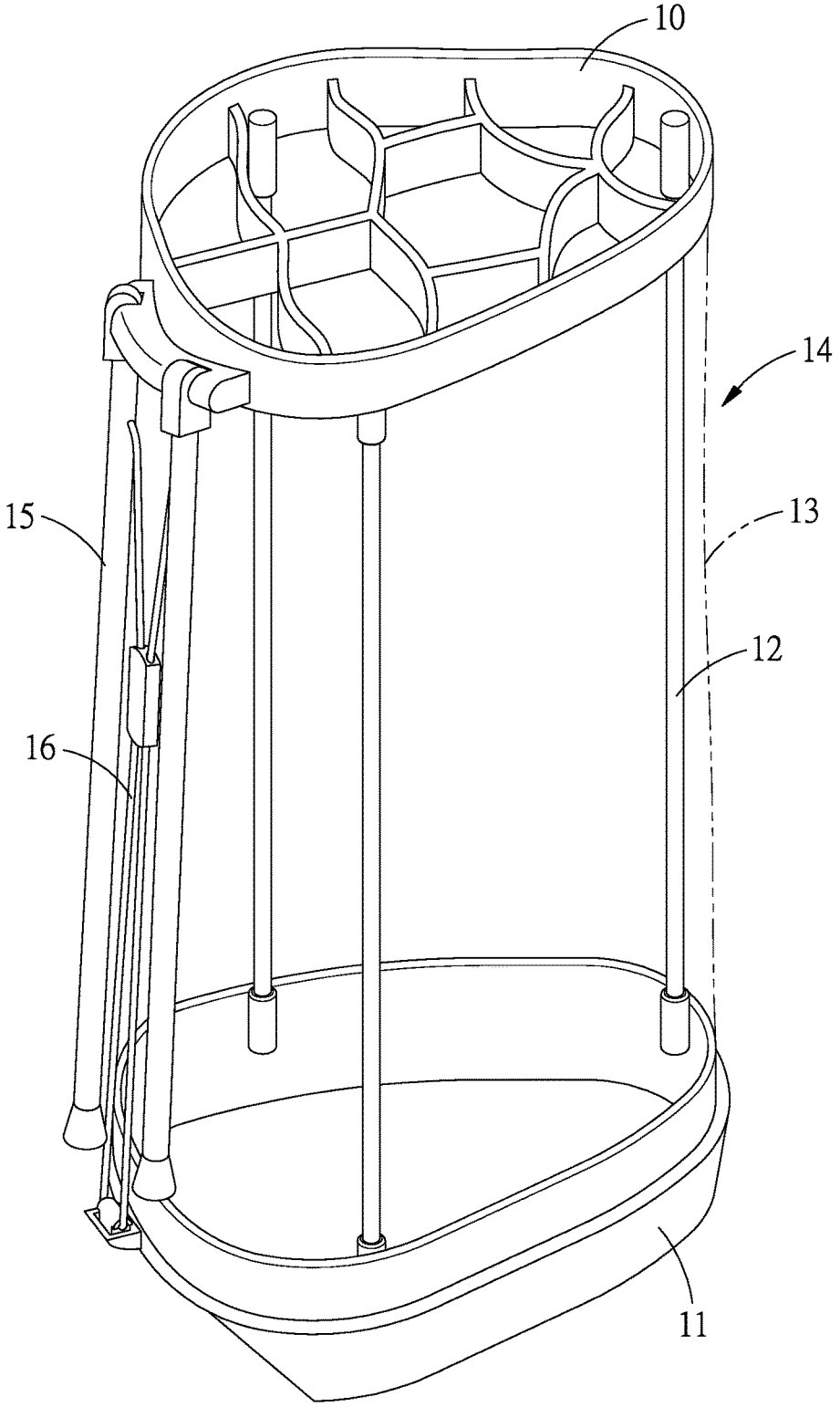
FIG.1 PRIOR ART
FIG. 1 is a perspective view of the conventional golf bag.
Figure 2:
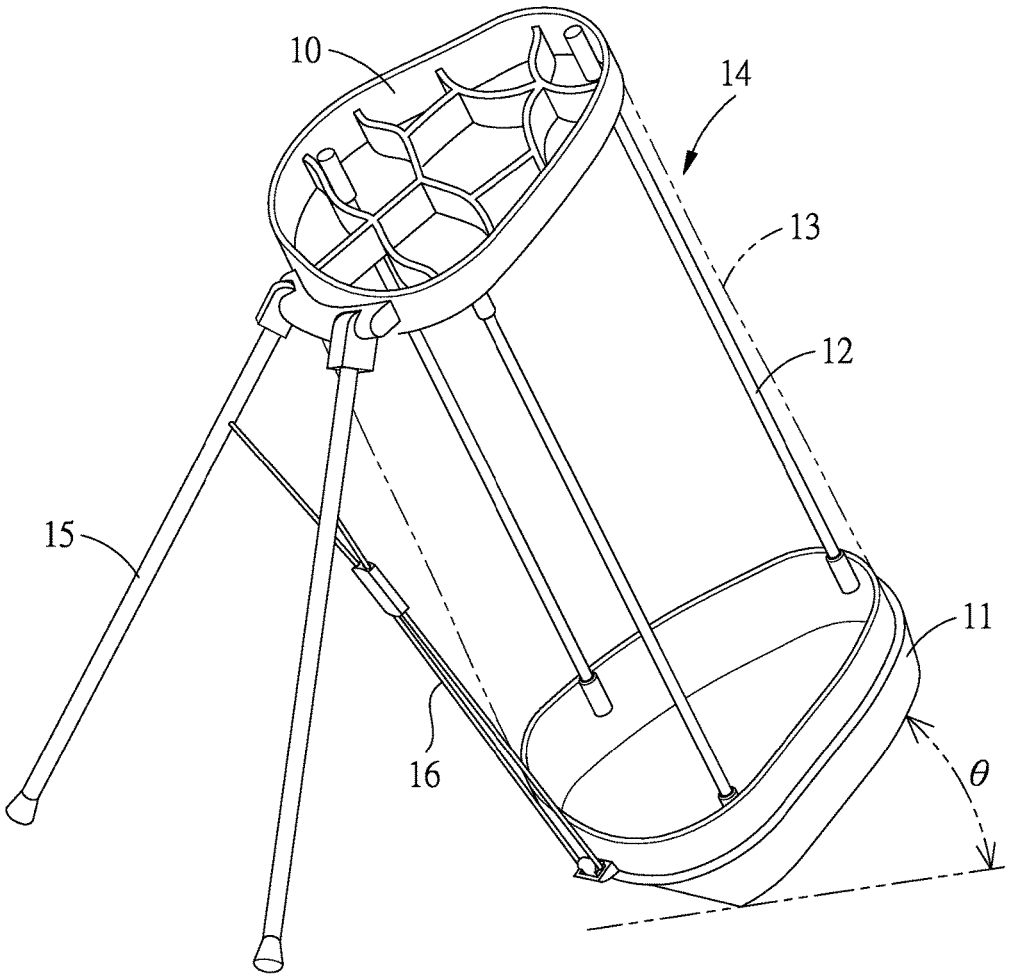
FIG.2 PRIOR ART
FIG. 2 is another perspective view of the conventional golf bag.
Figure 3:
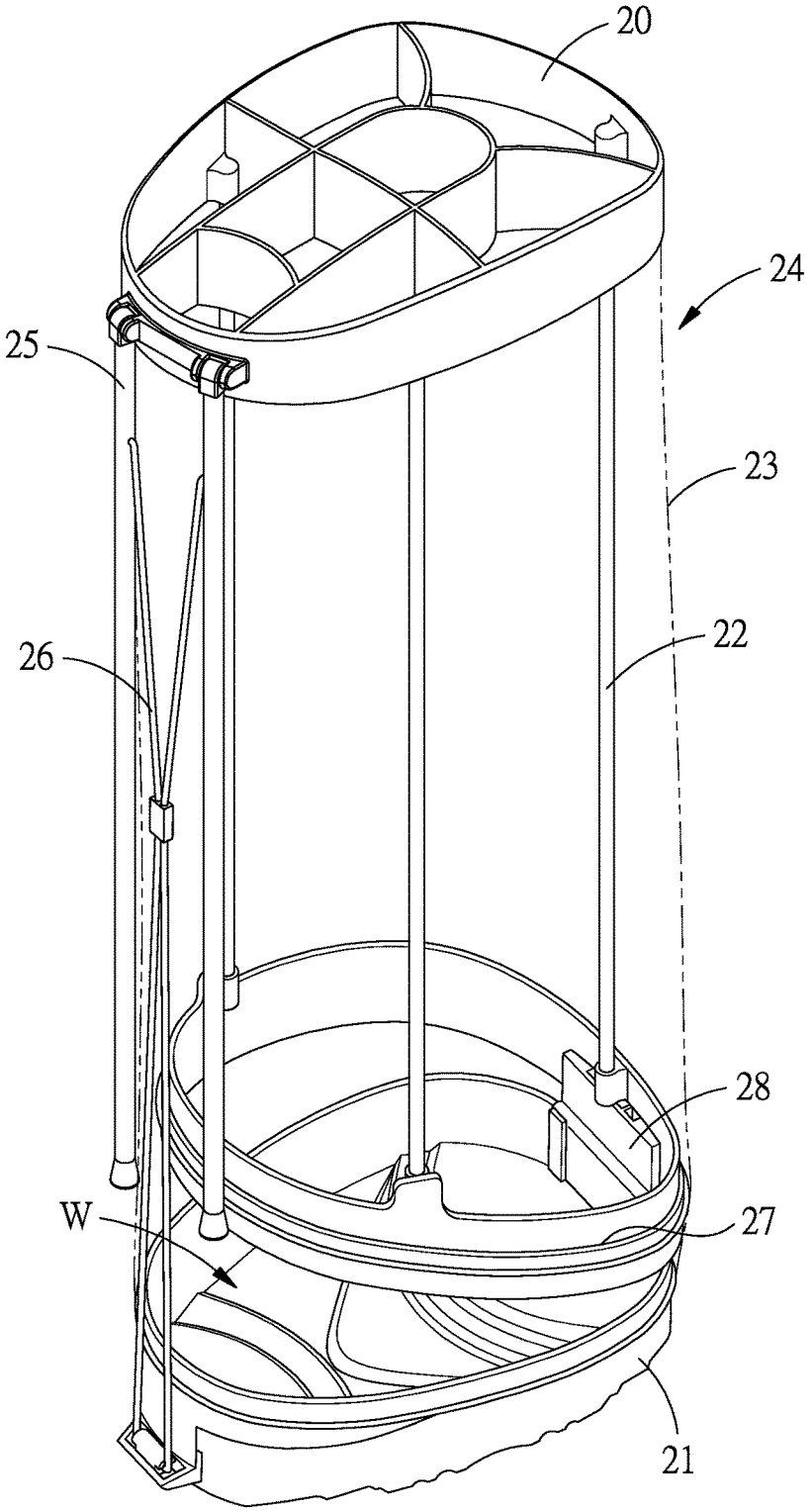
FIG.3 PRIOR ART
FIG. 3 is another perspective view of the conventional golf bag.
Figure 4:
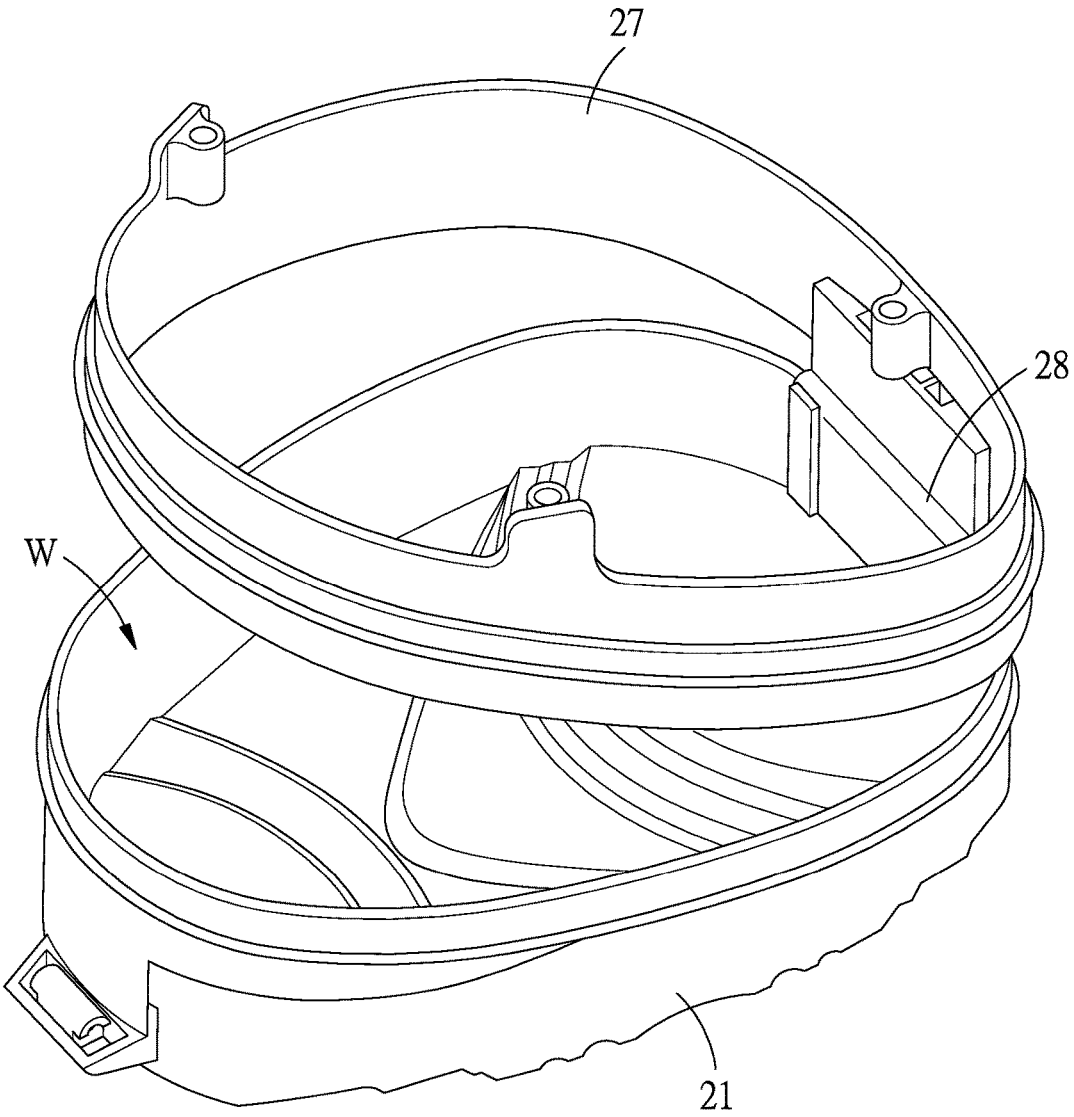
FIG.4 PRIOR ART
FIG. 4 is a perspective view of a part of the conventional golf bag.
Figure 5:
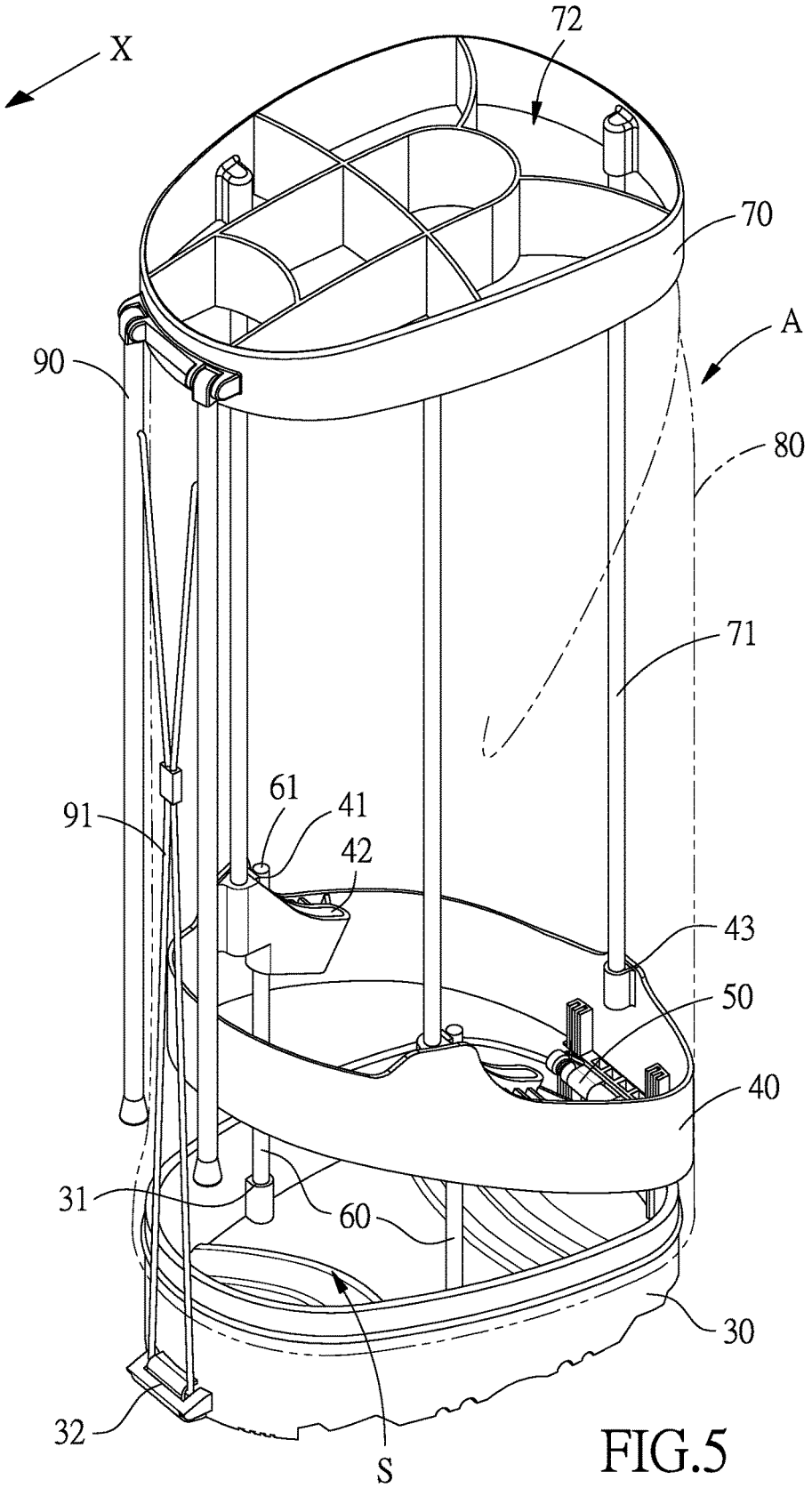
FIG. 5 is a perspective view of a golf bag in accordance with a preferred embodiment of the present invention, showing that the golf bag stands in a vertical position.

The present invention will be clearer from the following description when viewed together with the accompanying drawings, which show, for purpose of illustrations only, the preferred embodiment in accordance with the present invention.

Referring to FIGS. 5-9, a golf bag in accordance with a preferred embodiment of the present invention is provided with a lower frame 30, an inner frame 40, and two positioning support members 60, an upper frame 70, a plurality of inner support members 71, a cover 80 and an outer support member 90.

The lower frame 30 is provided with a plurality of first receiving cavities 31, and a connecting portion 32 at one end of the lower frame 30.

The inner frame 40 has one end pivoted to another end of the lower frame 30 via a pivoting device 50 and therefore is able to pivot with respect to the lower frame 30 by pivoting about the pivoting device 50. With support from the pivoting device 50, the inner frame 40 is maintained in an inclined position with respect to the lower frame 30, as a result, an inclined space S is formed between the lower and inner frame 30, 40. Two slots 41 are provided at two opposite sides of the inner frame 40, and at least one magnetic member 42 is provided on the inner surface of each of the slots 41. A plurality of second receiving cavities 43 are formed around the peripheral edge of the inner frame 40. Preferably, each of the slots 41 is connected to a corresponding one of the second receiving cavities 43, at the end of the inner frame 40 pivoted to the lower frame 30 is also formed one second receiving cavity 43. In an embodiment, there is only one magnetic member 42 on the inner surface of each of the slots 41 and located adjacent to the second receiving cavities 43.

The two positioning support members 60 each have a magnetic end 61 which is made of magnetically attractive metal inserted in a corresponding one of the slots 41 of the inner frame 40. Since the pivoting device 50 supports the inner frame 40 to maintain the inner frame 40 in an inclined position with respect to the lower frame 30, which makes the magnetic end 61 keep abutting against the end of the slot 41 where the magnetic member 42 is located. Therefore, the magnetic end 61 is attracted by the magnetic member 42, and another end of the each of the positioning support members 60 is inserted in a corresponding one of the first receiving cavities 31 of the lower frame 30, so that the inner frame 40 becomes more stable.

Preferably, a direction running from the one end of the lower frame 30 coupled to the inner frame 40 to the another end of the lower frame 30 where the connecting portion 32 is located is defined as a movable direction X. Each of the slots 41 extends along the movable direction X, and the positioning support members 60 are inserted in the slots 41, so that the inner frame 40 is only allowed to move along the direction X without swaying in other directions, and the connection between the inner and lower frames 40, 30 is accordingly improved.

Each of the inner support members 71 has one end inserted in a corresponding one of the second receiving cavities 43 of the inner frame 40 and another end fixed to the upper frame 70. The upper frame 70 is formed with a plurality of apertures 72 through which a user can take the golf club out the golf bags.

The cover 80 covers the upper frame 70, the lower frame 30, the inner frame 40 and the inner support members 71 to form a bag A.

The outer support member 90 is provided at the upper frame 70, and a resilient assistant support rod 91 is disposed between the outer support member 90, and has two ends connected to the outer support member 90 and the connecting portion 32 of the lower frame 30. The outer support member 90 and the resilient assistant support rod 91 are used to support the golf bag at the inclined position.

Figure 6:
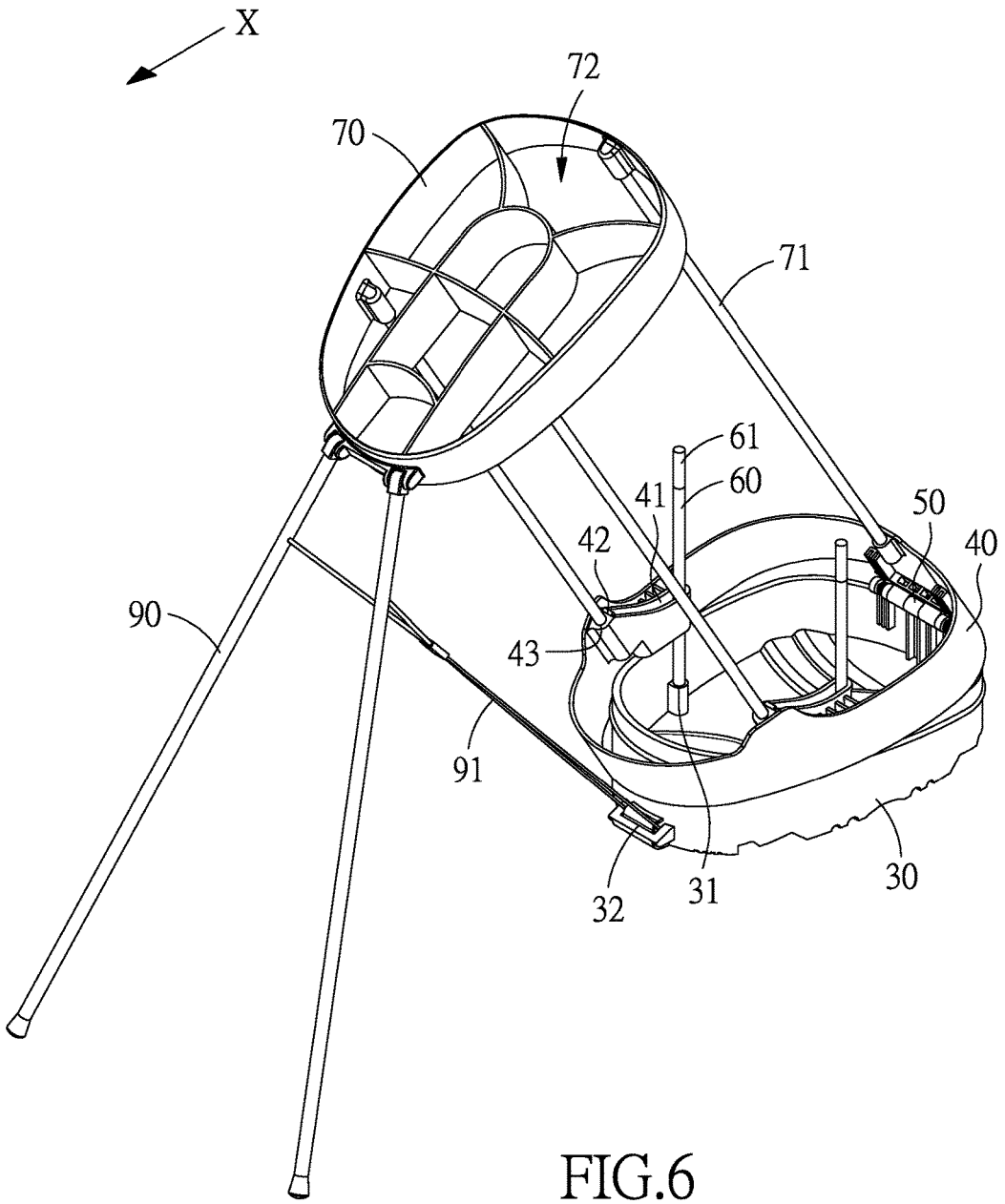
FIG. 6 is a perspective view showing that the golf bag in accordance with the preferred embodiment of the present invention stands in an inclined position.
Figure 7:
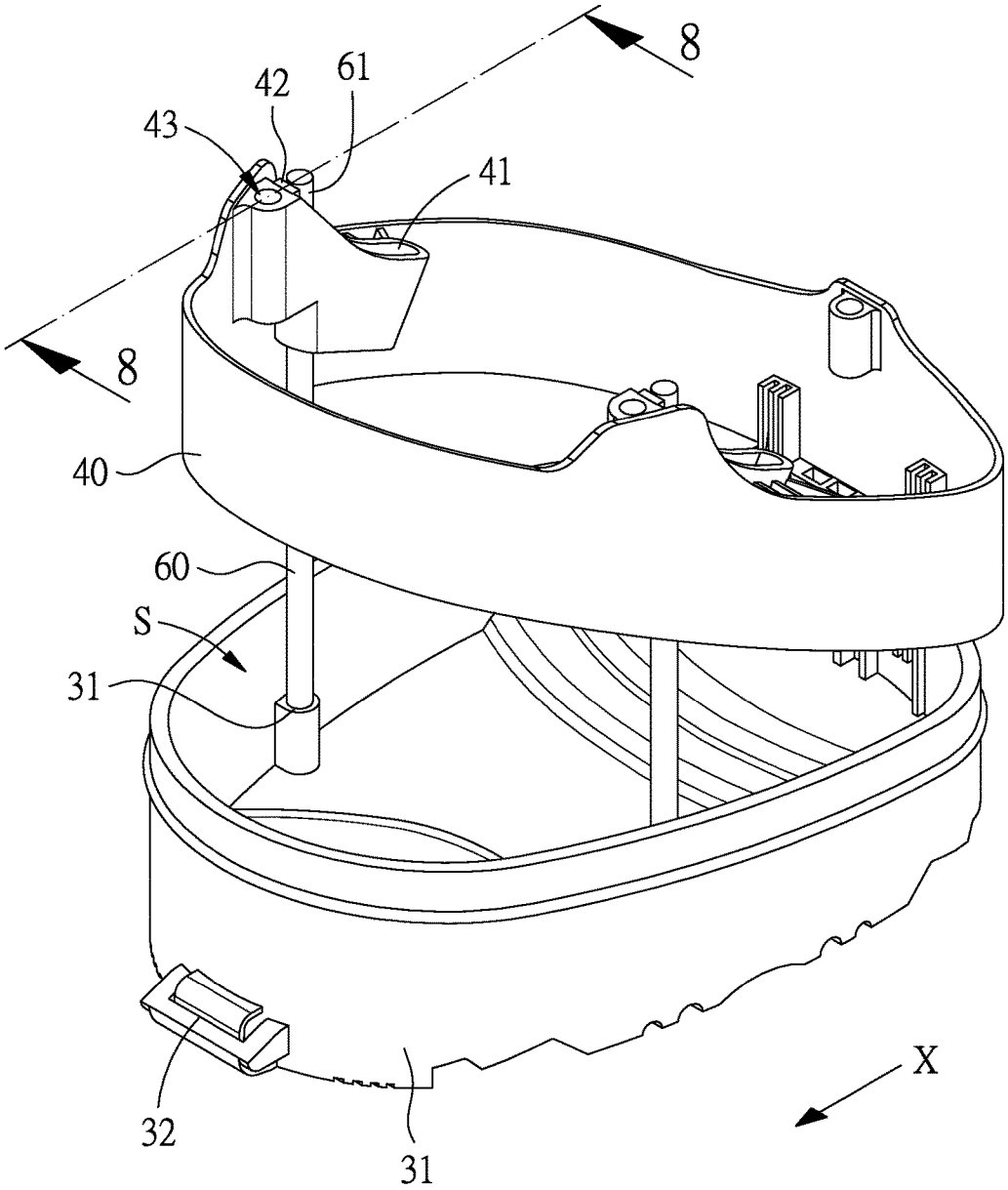
FIG. 7 is a perspective view of a part of the golf bag in accordance with the preferred embodiment of the present invention.
Figure 8:
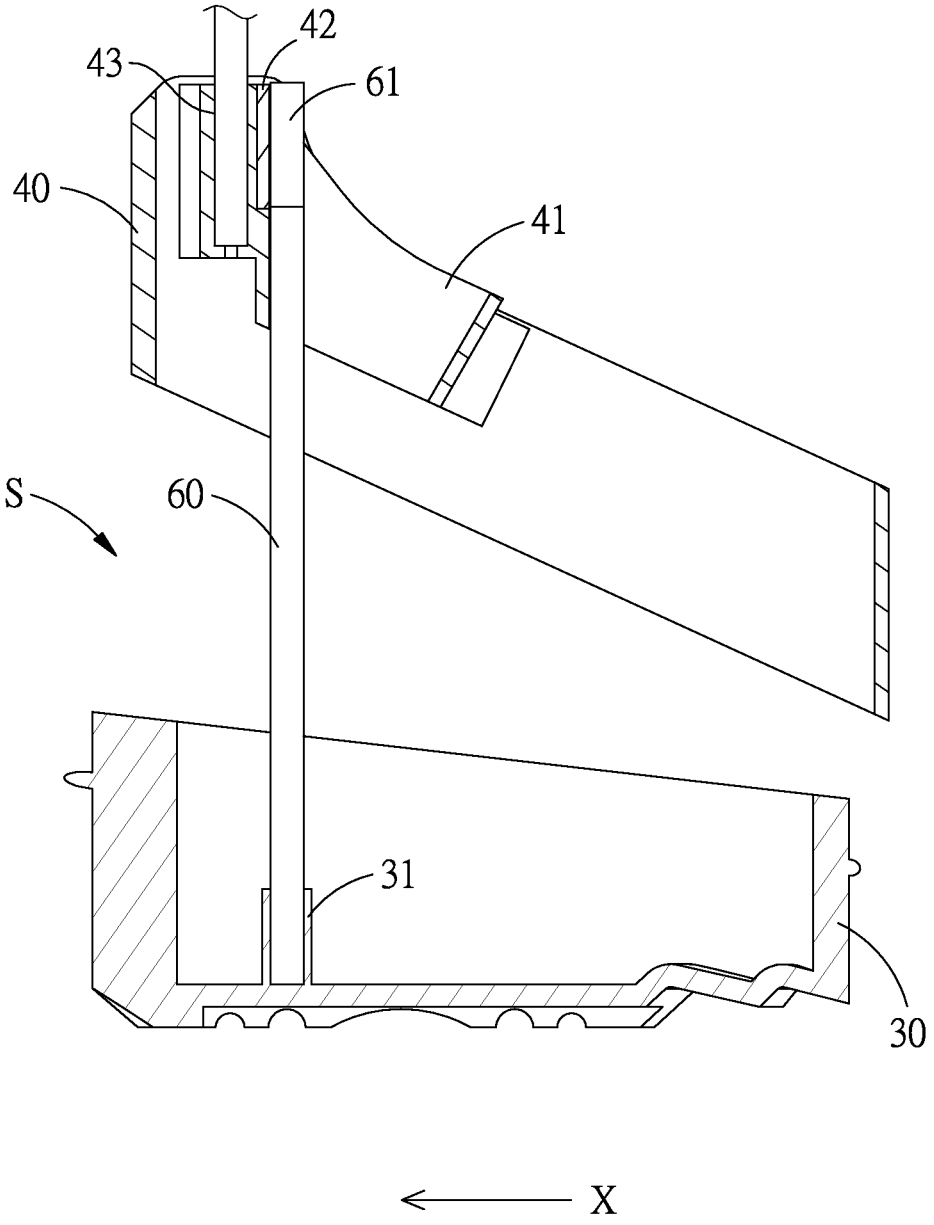
FIG. 8 is a cross sectional view of a part of the golf bag in accordance with the preferred embodiment of the present invention.
Figure 9:
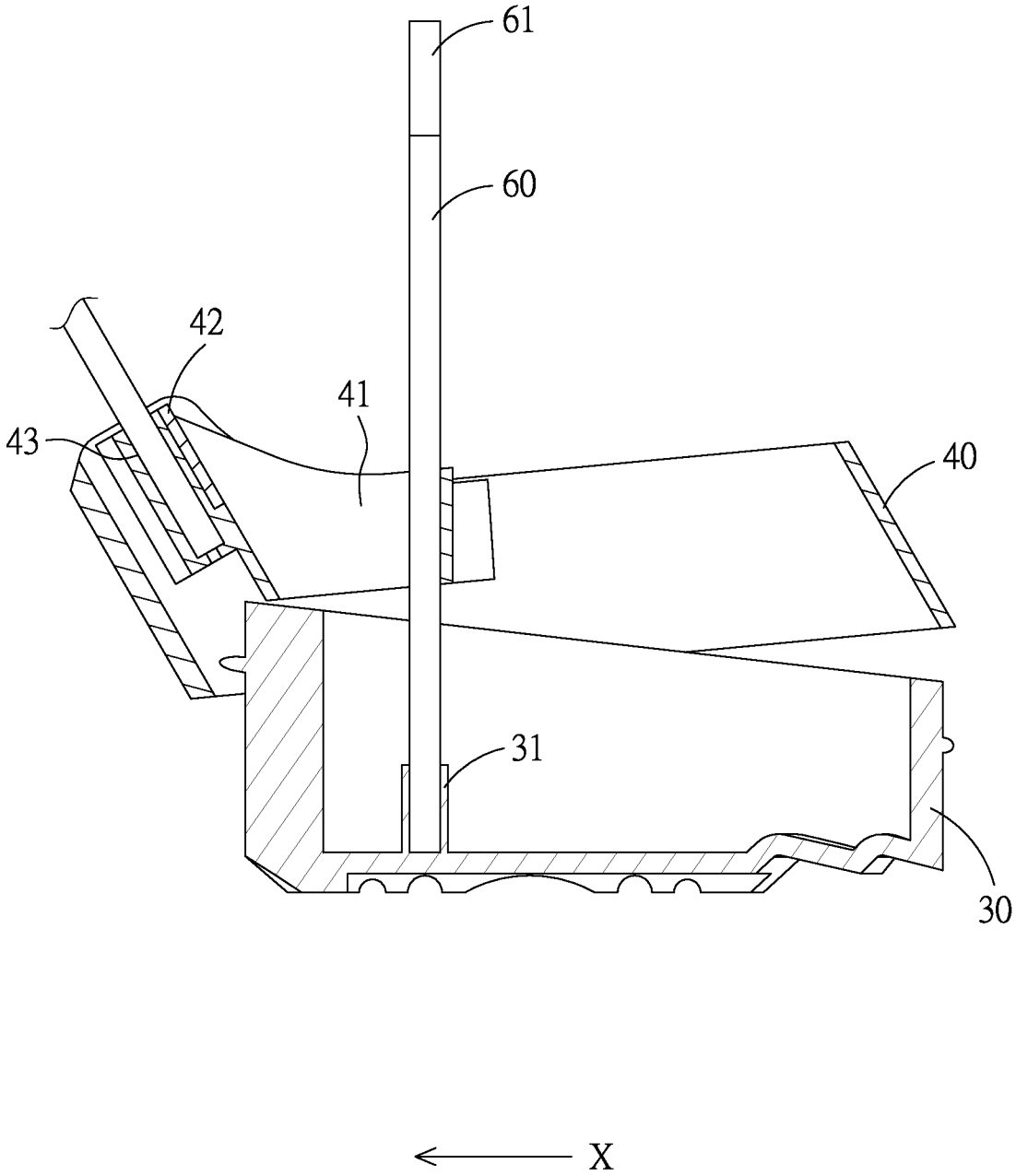
FIG. 9 is another cross sectional view of a part of the golf bag in accordance with the preferred embodiment of the present invention.

FIG. 6 shows the inclined status of the golf bag of the preferred embodiment of the present invention, when placed on the ground, the golf bag will naturally become inclined due to the weight of the golf club held in the golf bag. Since the inner frame 40 has one end pivoted to the lower frame 30 via the pivoting device 50 and the inclined space S is formed between the lower and inner frame 30, 40, when the inner frame 40 is inclined, and with the pivoting of the pivoting device 50, the upper frame 70 and the inner support members 71 can be inclined at the same angle with the inner frame 40, while the lower frame 30 still keeps fully and flatly abutting against the ground. Besides, the positioning support members 60 are inserted in the slots 41 to prevent the inner frame 40 from swaying with respect to the lower frame 30.

It is apparent from the above description that two slots 41 are provided at two opposite sides of the inner frame 40, the magnetic member 42 is disposed on the inner surface of each of the slots 41, the first receiving cavities 31 are formed on the lower frame 30, the magnetic end 61 of the positioning support members 60 are inserted in the slots 41 and attracted by the magnetic members 42, and another ends of the positioning support members 60 are inserted in the first receiving cavities 31, all these arrangements contribute to strengthening the connection between the inner and lower frames 40, 30, consequently stabilizing the structure of the golf bag.

While we have shown and described various embodiments in accordance with the present invention, it is clear to those skilled in the art that further embodiments may be made without departing from the scope of the present invention.

What is claimed is:

1. A golf bag, comprising:

a lower frame having a plurality of first receiving cavities;

an inner frame having one end pivoted to one end of the lower frame via a pivoting device so as to be able to pivot with respect to the lower frame by pivoting about the pivoting device, wherein an inclined space is formed between the lower and inner frame, two slots are provided at two opposite sides of the inner frame, at least one magnetic member is provided on an inner surface of each of the slots, and the inner frame is provided with a plurality of second receiving cavities around the peripheral edge thereof;

two positioning support members each having a magnetic end which is made of magnetically attractive metal inserted in a corresponding one of the slots of the inner frame, wherein the magnetic end is attracted by the magnetic member, and another end of the each of the positioning support members is inserted in a corresponding one of the first receiving cavities of the lower frame;

an upper frame having a plurality of apertures;

a plurality of inner support members, each having one end inserted in a corresponding one of the second receiving cavities of the inner frame and another end fixed to the upper frame;

an outer support member provided on the upper frame; and a cover covering the upper frame, the lower frame, the inner frame, and the inner support members to form a bag.

2. The golf bag as claimed in claim 1, wherein a connecting portion is formed at an end of the lower frame, which is opposite to the end pivoted to the inner frame, and an assistant support rod is connected to the outer support member and the connecting portion of the lower frame respectively.

3. The golf bag as claimed in claim 1, wherein there is one said magnetic member on the inner surface of each of the slots, and the magnetic end keeps abutting against one end of the slots where the magnetic member is located.

4. The golf bag as claimed in claim 2, wherein a direction running from the one end of the lower frame coupled to the inner frame to the another end of the lower frame where the connecting portion is located is defined as a movable direction, and each of the slots extends along the movable direction.

5. The golf bag as claimed in claim 1, wherein each of the slots is connected to a corresponding one of the second receiving cavities, and at the end of the inner frame pivoted to the lower frame is also formed one said second receiving cavity.

* * * * *